US005288262A

United States Patent [19]

Phillips

[11] Patent Number: 5,288,262

[45] Date of Patent: Feb. 22, 1994

[54] CRAZY WHEELS TOY

[76] Inventor: E. Lakin Phillips, 2733 Centreville Rd., Herndon, Va. 22071

[21] Appl. No.: 806,372

[22] Filed: Dec. 13, 1991

[51] Int. Cl.[5] ..... A63H 33/02; A63H 17/00; A63H 5/00

[52] U.S. Cl. ..... 446/451; 446/437; 446/412; 273/441

[58] Field of Search ..... 446/451, 456, 452, 453, 446/437, 413, 411, 412, 287, 289, 292; 273/440, 441, 446; 128/57

[56] References Cited

U.S. PATENT DOCUMENTS

| | | | |
|---|---|---|---|
| D. 82,315 | 10/1930 | Cramer | 446/289 X |
| 1,074,596 | 10/1913 | Becher | 446/450 X |
| 1,663,169 | 3/1928 | Marx | 446/437 |
| 1,676,085 | 7/1928 | Gerrish | 446/451 |
| 3,623,264 | 11/1971 | Sapienza | 446/451 |
| 3,659,375 | 5/1972 | Stubbmann | 446/7 |
| 3,756,333 | 9/1973 | Rubin | 446/443 X |
| 3,758,984 | 9/1973 | Spransy et al. | 446/453 |
| 4,317,307 | 3/1982 | Conry | 446/451 |
| 4,682,971 | 7/1987 | Washington | 446/456 |
| 4,799,917 | 1/1989 | Lentz | 446/450 |

FOREIGN PATENT DOCUMENTS

| | | | |
|---|---|---|---|
| 744913 | 10/1966 | Canada | 446/450 |
| 326715 | 10/1920 | Fed. Rep. of Germany | 446/451 |
| 1381156 | 10/1964 | France | 446/287 |
| 2455161 | 8/1980 | France | 446/451 |
| 273730 | 5/1930 | Italy | 446/437 |

*Primary Examiner*—Robert A. Hafer
*Assistant Examiner*—D. Neal Muir
*Attorney, Agent, or Firm*—Glenna Hendricks

[57] ABSTRACT

A push wheel toy is disclosed where a handle is attached to pair of wheels on an axle. The axle is contorted so that the wheels are not necessarily parallel nor will the toy move in a straight line unless carefully controlled. The handle is loosely attached so that any point along the axle may be used to propel the toy. The toy may not only be used as a simple push toy, but may also be useful in therapy for those suffering motor control disability, and as a game between several individuals.

5 Claims, 2 Drawing Sheets

CRAZY WHEELS TOY

The invention provides a toy comprising wheels attached to an axle which is contorted, wherein the axle has attached thereto a handle which moves freely along its length whereby the direction of the wheels can be manipulated.

BACKGROUND OF THE INVENTION

Toys have been designed for production of unexpected or erratic movement. Examples of such toys can be seen, for example, in boinks, which are woven plastic tubes that spring in different directions when they are compressed and released and in balls that do not follow a straight path. An example of the latter is disclosed in U.S. Pat. No. 3,995,855 to Schultz. The ball described therein has an outer ball constructed of light weight rubber and an inner ball constructed of a high bounce or very resilient rubber material.

DETAILED DESCRIPTION OF THE INVENTION

The instant invention provides a toy having two wheels connected by a contorted or bent axle that undulates as the wheels roll along the floor. Attached to the axle is a handle that is attached to the axle though a connecting means that moves freely along the length of the axle so that the direction of the wheels can be manipulated by the position of the connecting part on the axle and the direction of pressure on the handle.

Figure 1:
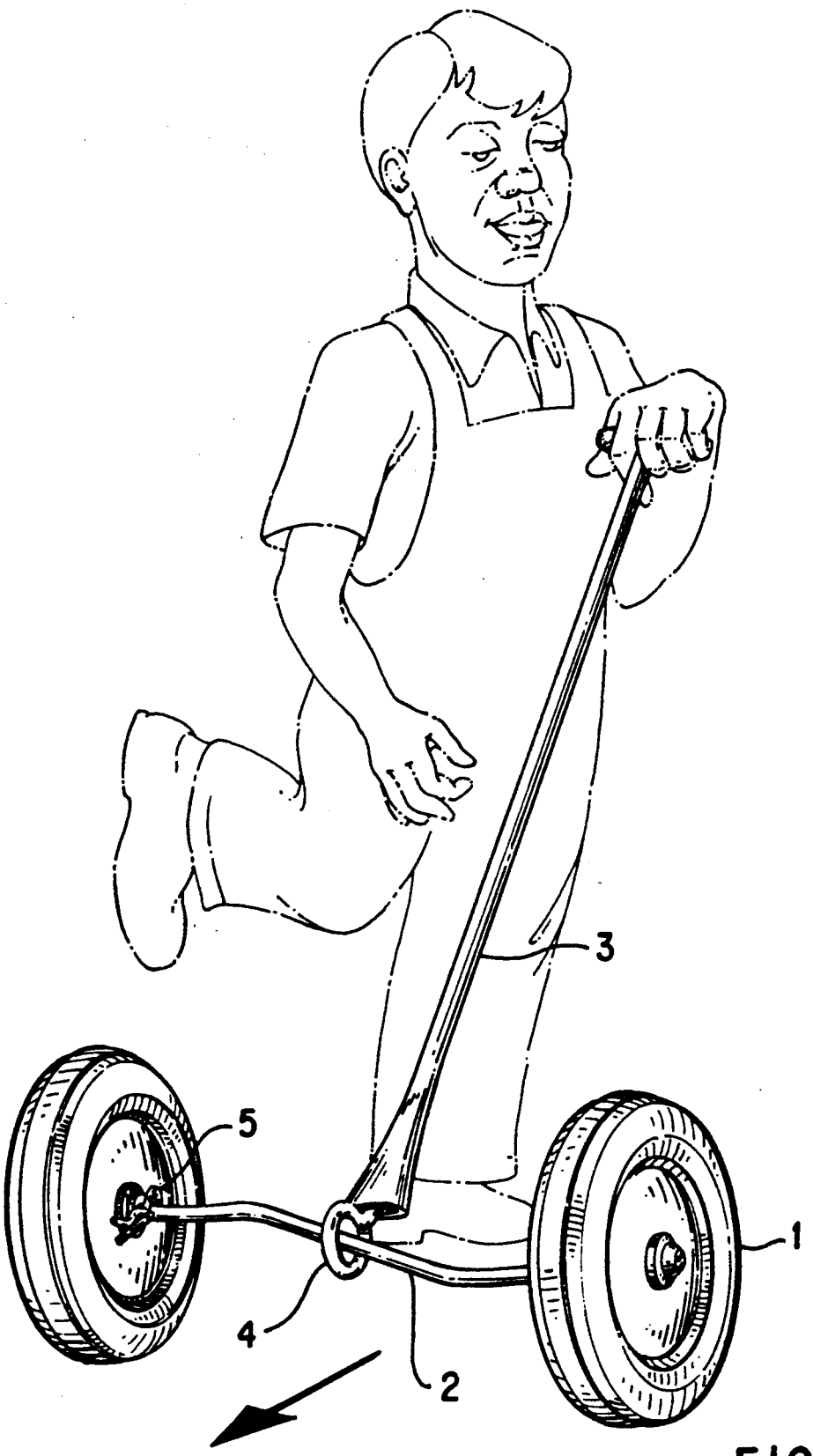
FIG. 1 shows the Crazy Wheels of the invention being manipulated by a person.
Figure 2:
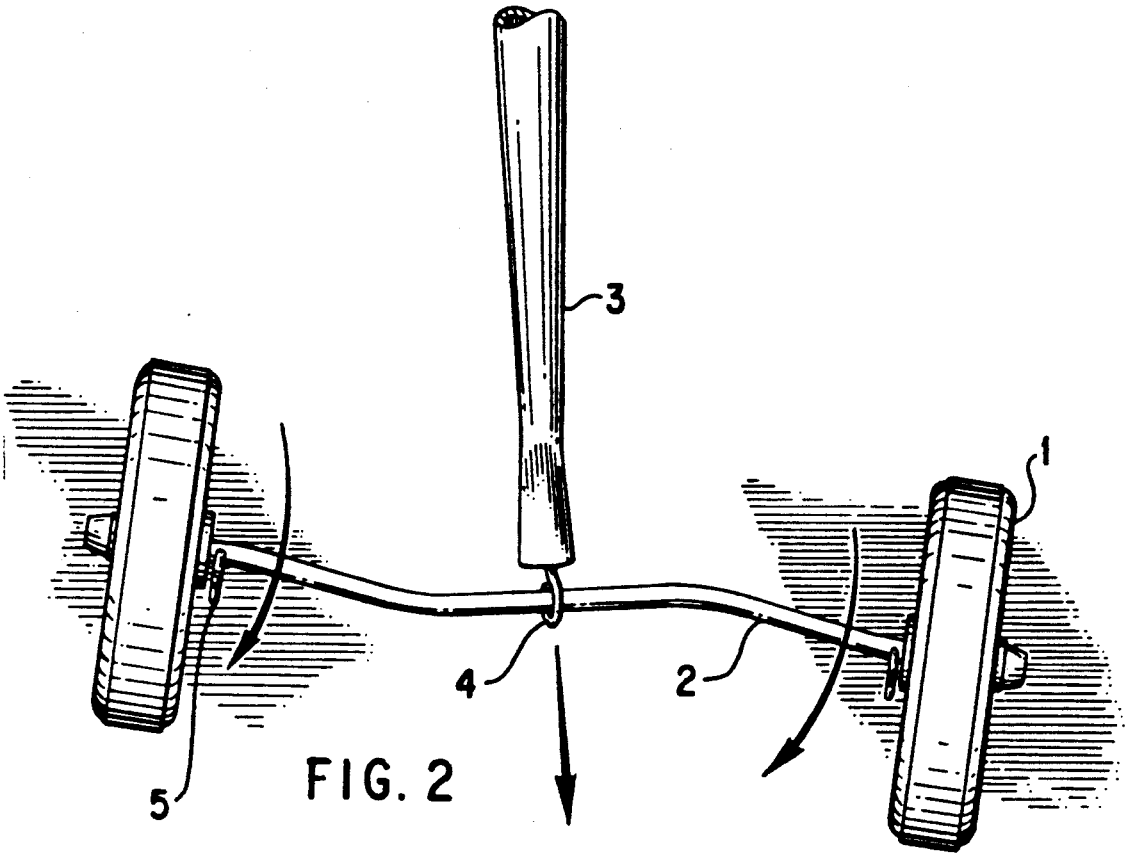
FIG. 2 indicates the line of movement of the wheels.
Figure 3:
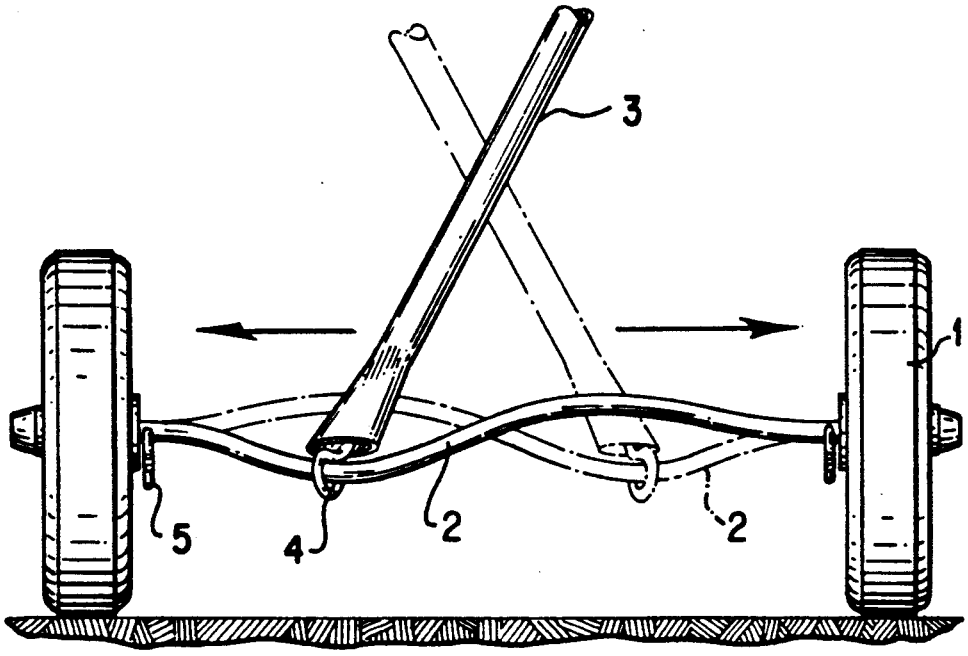
FIG. 3 shows the movement of the handle to control the wheels.

Referring to the figures, FIG. 1 shows wheels (1) on a contorted axle (2) which undulates when the toy is propelled forward. The handle (3) is attached, in this instance, has a connecting means (4) which is a ring. The wheels are held in position on the axle by pins (5), in this instance, by cotter pins. FIG. 2 shows the same toy as FIG. 1, and indicates the change in direction of the wheels in response to pressure on the handle. In FIG. 3, there is illustrated the movement of the handle to effect direction of path of the wheels.

The difficulty in maintaining a straight path of movement depends on several factors including the amount of contortion in the axle and the degree of freedom of movement between the connecting means at the end of the handle proximal to the axle and the axle.

The toy of the invention can be made any size depending on whether it is to be used on the floor or grass or on a higher surface such as a desk top. The means by which the handle is connected to the axle may be either an integral part of the handle or may be detachable from the handle. For example, the connecting means may be a ring or "eye" with a screw that attaches to the handle. The wheels would be available as single units or in a series of sets that would present varying degrees of difficulty for the operator who would try to move the wheels in a straight line. When the toys are sold as sets, it would be possible to have only one handle if a connecting means attached to the axle connecting the wheels were detachable from the distal portion of the handle. It would also be possible to provide one set of wheels and several different axles having varying degrees of contortion. The wheels moved from one axle to another.

In playing games, the surface on which the wheels are to roll could be marked with tracks that would delineate the acceptable breadth limits for movement. Some surfaces such as tile or wood floors might have "markings" that would be appropriate for evaluating whether or not the operator had succeeded in keeping the wheels "on track" The toys of the invention could also be used out of doors with "tracks" outlined by strips of tape. Teams or individuals could be ranked on basis of ability to maintain toys on track for a given distance and within time constraints with greater credit given for successful "driving" of toys having the more contorted axles. Crazy Wheels could be played either as an individual or team competition.

The toys of the invention also have use for helping children, including handicapped children, develop improved eye-hand coordination since the manipulation of the toy requires sideways, forward, backward and corrective movements. Hence, use of Crazy Wheels to enhance development would be of great value in home, school, rehabilitation facility, or hospital setting. A particularly advantageous aspect of this toy is that the child is able to use the toy alone for both amusement and development of improved coordination, since he could "test" himself and so observe his own progress.

Toys of the invention for table top use would also be a means of entertaining adults and children in more confined settings.

I claim:

1. A toy comprising a bent axle having a wheel attached to each end by a wheel connecting means, said axle being attached through a connecting means to a handle for applying propulsion and guidance, wherein said connecting means loosely engages said axle along the extent of said axle between the wheels or wheel connecting means so that a movement of said toy is responsive to any chosen position of said connecting means on said axle and direction of pressure on said handle.

2. A toy of claim 1 wherein the wheels are secured in position by cotter pins.

3. An article of claim 1 wherein the handle is an integral part of the connecting means by which the handle portion is connected to the axle.

4. An article of claim 1 wherein the handle can be disconnected from the connection means that moves along the axle.

5. A push toy for teaching motor coordination and skills comprising a contorted undulating axle having a wheel attached to each end by wheel connecting means, said axle being attached through a connecting means to a handle for applying propulsion and guidance, wherein said handle is displaced from said axle by said connecting means having an elongated portion and a portion which loosely engages said axle at any point between the wheels or said wheel connecting means in such a manner that said toy may be propelled in a variety of directions by alteration of position of said connecting means on said axle and direction of pressure on said handle.

* * * * *